United States Patent [19]

Knaack et al.

[11] 4,383,721

[45] May 17, 1983

[54] STORAGE BOX CLOSURE CONTROL

[75] Inventors: Howard L. Knaack; Kenneth F. Weger, Jr., both of Cary, Ill.

[73] Assignee: Knaack Manufacturing Company, Crystal Lake, Ill.

[21] Appl. No.: 348,649

[22] Filed: Feb. 12, 1982

[51] Int. Cl.[3] ..... A47B 88/00; A47B 95/00

[52] U.S. Cl. ..... 312/319; 220/335; 217/60 R

[58] Field of Search ..... 220/335; 217/60 R; 312/290, 300

[56] References Cited

U.S. PATENT DOCUMENTS

| | | | |
|---|---|---|---|
| 2,758,900 | 8/1956 | Marchand | 312/319 |
| 2,802,711 | 8/1957 | Ulrich, Sr. | 312/319 |
| 3,330,612 | 7/1967 | Masterson et al. | 312/319 |

OTHER PUBLICATIONS

McMaster Carr Supply Company Catalog 84, p. 103.

*Primary Examiner*—George T. Hall

*Attorney, Agent, or Firm*—Wood, Dalton, Phillips, Mason & Rowe

[57] ABSTRACT

A closure control for a storage box or the like having a heavy lid selectively movable between a closed position, wherein the lid closes an upwardly opening receptacle for receiving tools and the like, and an open position wherein the lid extends upwardly from a rear wall of the receptacle to provide facilitated access to the interior thereof. Movement of the closure lid between the closed and opened positions is assisted by a sealed pneumatic spring device. The spring device is arranged to provide a controlled rate of extension. The spring device is mounted within the receptacle in such a manner as to be protected against damage from articles placed into the receptacle. In the illustrated embodiment, the spring is located at the rear corners of a parallelepiped receptacle. In the illustrated embodiment, wall structures are provided adjacent the spring to further protect the spring against injury from articles placed in the receptacle. The spring is arranged so as to cause a gentle lowering of the lid such as by inadvertent movement thereof from the open position to the closed position, thereby preventing injury to the user of the storage box.

20 Claims, 4 Drawing Figures

FIG. 1
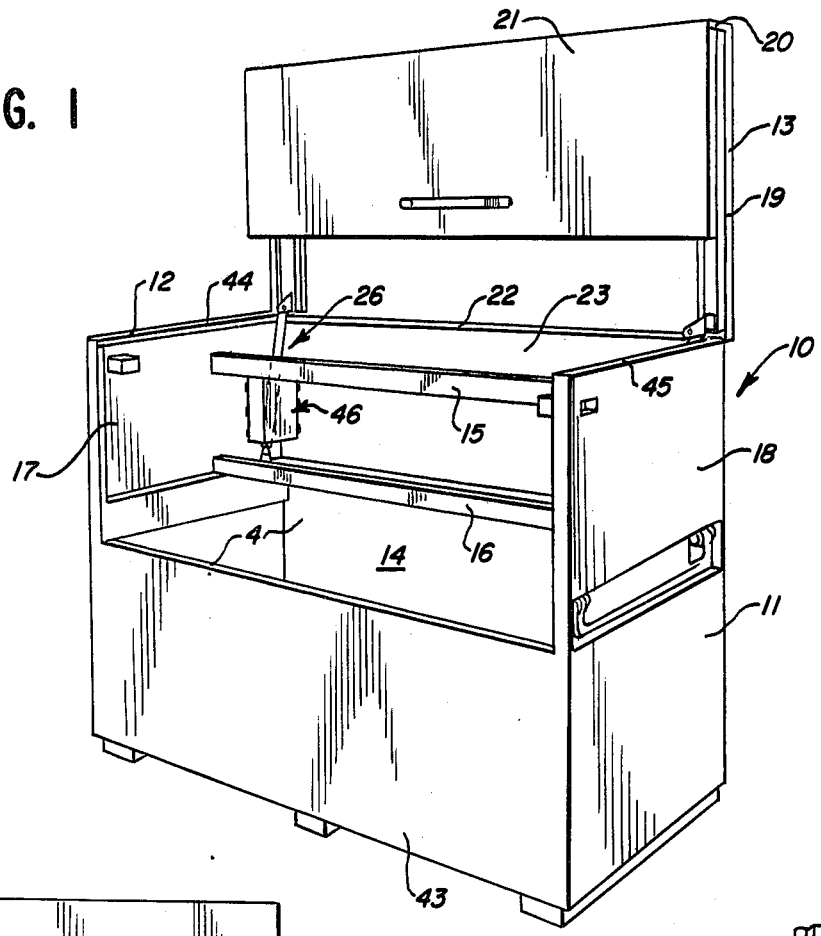
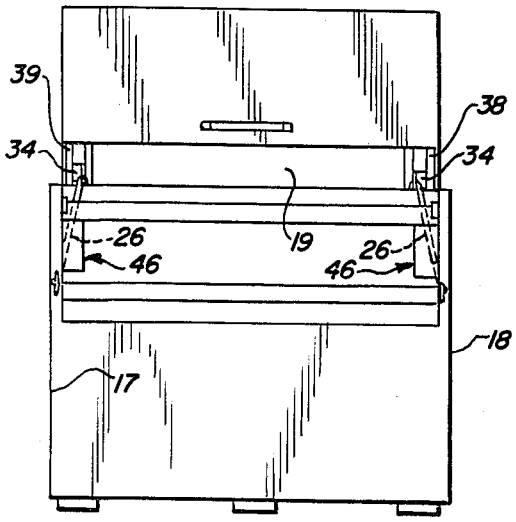
FIG. 2
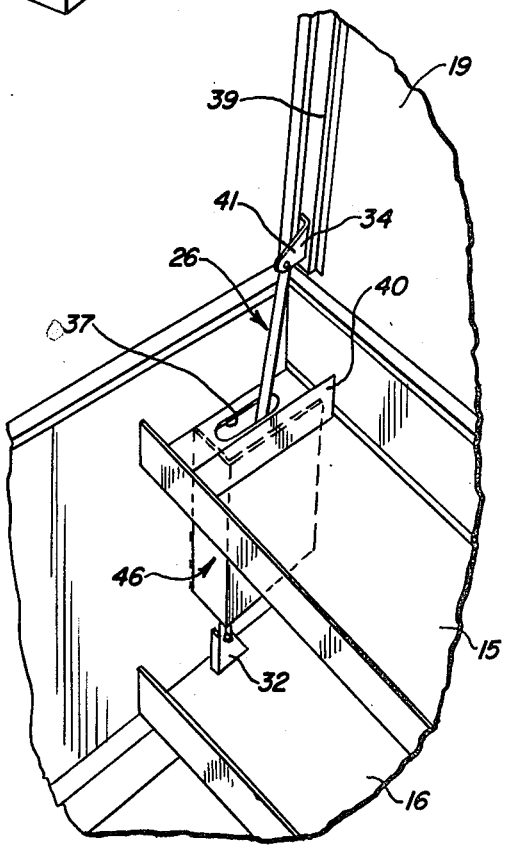
FIG. 3

STORAGE BOX CLOSURE CONTROL

BACKGROUND OF THE INVENTION

1. Field of the Invention

This invention relates to storage boxes and in particular to means for providing controlled movement of a relatively heavy closure lid provided for selectively closing an access opening to the storage box receptacle.

2. Description of the Background Art

In one improved form of storage box, a relatively heavy closure lid is provided for closing an upwardly opening access opening to the interior of the receptacle of the storage box for facilitated placement into and removal from the receptacle of articles, such as tools and the like being stored therein.

Such storage boxes may be of relatively large size for industrial use and the closure lids thereof are relatively heavy, illustratively weighing 80 lbs. or more.

The closure lids are conventionally hingedly connected to an upper rear wall portion of the receptacle and, thus, conventionally, are swung upwardly from the closed position across the access opening to an upright, open position. Such movement of the relatively heavy closure lid requires substantial force by the user and presents a problem where the user has limited strength.

Another problem which has arisen in such storage boxes is the inadvertent swinging of the closure lid from the upright, open position back to the closed position, such as by a sudden gust of wind where the box is used in outdoor applications. The relatively heavy closure lid may cause serious injury to the user, such as where the user's hands are disposed at the upper edges of the receptacle when such inadvertent movement occurs.

It has been known to counterbalance closure lids in applications, such as automobile trunks, etc. A wide range of different devices has been developed for such counterbalancing purposes.

SUMMARY OF THE INVENTION

The present invention comprehends an improved storage box structure wherein an expansible spring is provided for assisting movement of the relatively heavy closure lid thereof.

The invention comprehends means for locating the expansible spring in a rear portion of the receptacle so as to minimize potential damage to the spring as by placement of articles in the receptacle in normal use.

More specifically, the invention comprehends the provision in a storage box having an upwardly opening receptacle having a rear portion defining a rear wall and a heavy metal closure swingably mounted to the rear wall for selective positioning in a raised, open position and a lowered, receptacle-closing position, an improved closure movement assist means including an elongate, longitudinally expansible spring having a lower end and an upper end, means for connecting the lower end to the receptacle rear portion, and means for connecting the upper end to the closure adjacent the rear wall, the spring developing a lifting force preselected to be slightly less than the downward force caused by the weight of the closure in the receptacle-closing position, slightly more than the downward force caused by the weight of the closure in the open position, and substantially equal to the downward force caused by the closure in an intermediate position intermediate the receptacle-closing and open positions.

The spring preferably includes means for controlling the rate of movement of the closure between the open and closed positions.

The invention comprehends the further provision of wall means disposed adjacent the spring for preventing engagement with the spring of objects placed in the receptacle.

In the illustrated embodiment, the receptacle includes a horizontal shelf adjacent the rear wall having an opening therein with the spring extending through the opening.

The connecting means are constructed to have a break strength less than that of the spring for effectively precluding breaking of the spring in use of the storage box.

The spring includes a mild steel piston rod having limited flexure for reduced possibility of breakage in the normal use of the storage box.

The spring is arranged to extend in a generally upright direction, which, in the illustrated embodiment, is generally similar in each of the receptacle-closing and open positions.

The lower end of the spring is raised above a horizontal wall to which it is mounted by a connecting means so as to prevent damage to the lower end of the spring by objects placed on the horizontal wall.

The spring extends angularly upwardly away from the sidewalls of the receptacle so as to provide improved clearance therewith in moving the closure between the open and closed positions.

The receptacle defines a top edge portion to which the closure is brought in effecting a closing of the receptacle. The spring is arranged to effectively balance the weight of the closure as it moves to the closed position, thereby effectively preventing injury to a user's hands or the like disposed between the closure and the upper edge of the receptacle when the closure moves to the closed position.

The closure includes a front portion hanging downwardly so as to extend below the receptacle top edge front portion in the receptacle closing position.

In the illustrated embodiment, the closure has a weight of greater than approximately 75 lbs.

In the illustrated embodiment, a pair of springs is provided disposed one each in the rear corners of the parallelepiped receptacle for improved controlled movement of the closure.

In the illustrated embodiment, the spring comprises a sealed pneumatic gas spring device.

The closure assist means of the present invention is extremely simple and economical of construction while yet providing the highly desirable features and advantages discussed above.

BRIEF DESCRIPTION OF THE DRAWING

Other features and advantages of the invention will be apparent from the following description taken in connection with the accompanying drawing wherein:

FIG. 1 is a perspective view of a storage box provided with closure-assist spring means embodying the invention;

FIG. 2 is a front elevation thereof;

FIG. 3 is a fragmentary perspective view illustrating the arrangement of the spring means in greater detail.

DESCRIPTION OF THE PREFERRED EMBODIMENT

Figure 4:
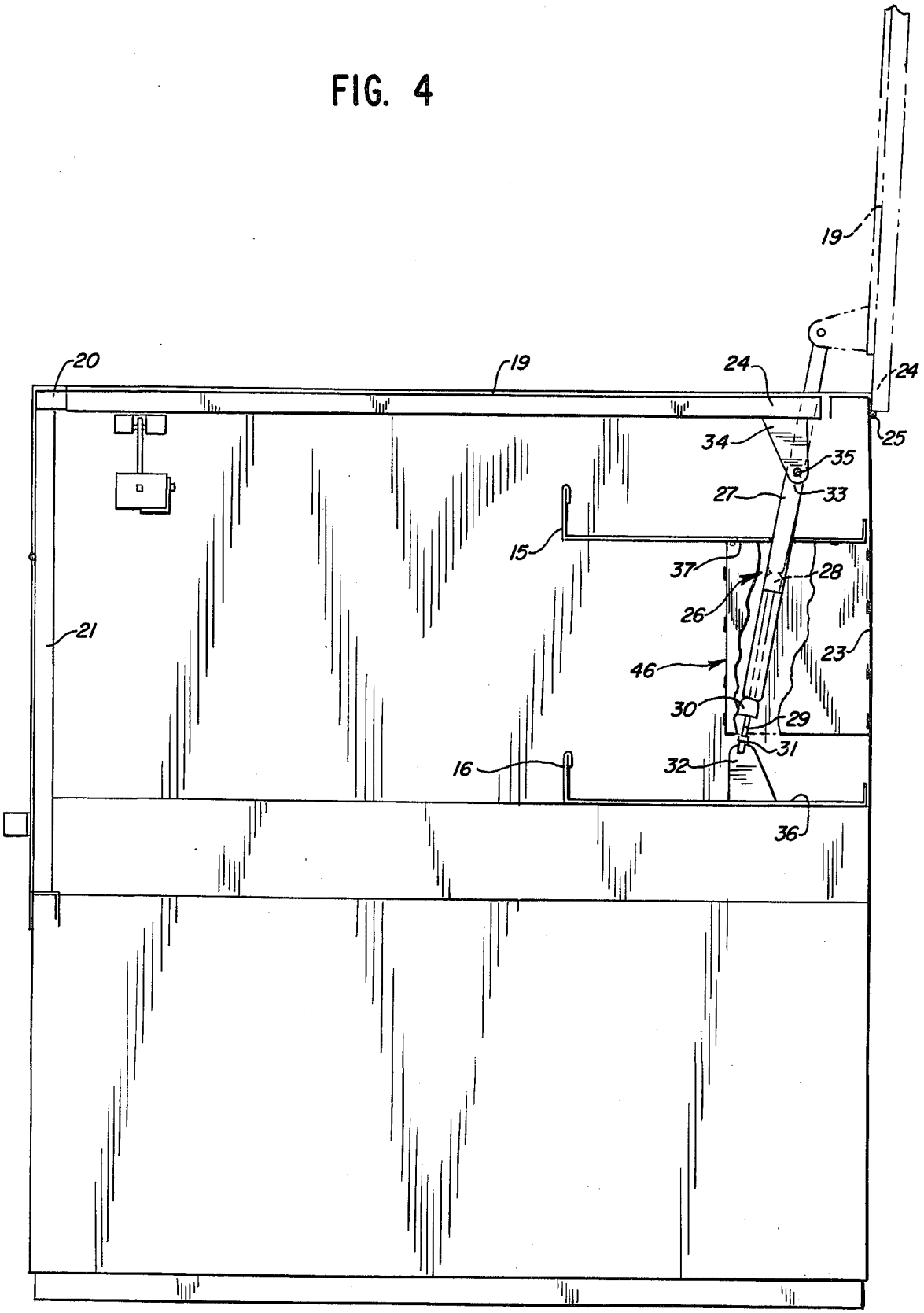
FIG. 4 is a vertical section illustrating the arrangement of the closure and spring means in closed disposition in full lines, and in open disposition in broken lines.

In the illustrative embodiment of the invention as disclosed in the drawing, a storage box generally designated 10 is shown to include a receptacle 11 defining an access opening 12 selectively closed by a closure, or lid, 13. As shown in FIG. 1, the access opening extends across the top and upper front portion of the receptacle cabinet 11 so as to provide facilitated access to the equipment space 14 within the receptacle.

As discussed briefly above, such storage boxes may be relatively large, as for professional tool storage, and the closures 13 thereof may be relatively heavy. Illustratively, such closures may weigh upwards of 75 lbs. or more, and in the illustrated embodiment, the closure weighs approximately 84 lbs.

As further illustrated in FIG. 1, the receptacle may be provided with an upper rear shelf 15 and a middle rear shelf 16 extending the width of the receptacle between the left sidewall 17 and right sidewall 18 thereof.

As illustrated in FIG. 1, the closure may include a top panel 19, an intermediate panel 20, and a front panel 21, which are swingably connected by suitable hinge means. The top panel 19 is hingedly connected to the top edge 22 of a rear wall 23 of the receptacle so as to swing between an upwardly extending disposition, as shown in broken lines in FIG. 4, to a horizontal receptacle-closing position, as shown in full lines therein. As seen in FIG. 4, in the closed position, front panel 21 extends downwardly across the front portion of the access opening 12 to cooperate with the top panel 19 and intermediate panel 20 in effectively sealingly closing the box. As further illustrated in FIG. 4, the rear edge 24 of the top panel is connected to the rear wall edge 22 by a hinge 25 to provide the desired swinging movement.

As indicated briefly above, the invention comprehends the provision of an expansible spring means generally designated 26, for assisting movement of the closure between the closed and open positions in the normal use of the storage box. The expansible spring comprises an elongated, longitudinally extending spring, which, in the illustrated embodiment, is a gas spring of well-known construction. The spring includes a pressure cylinder 27 in which is received a piston assembly 28 connected to a piston rod 29 extending downwardly from the lower end 30 of the cylinder and having a lower connection 31 connected to an upstanding bracket 32 on the shelf 16. The upper end 33 of the cylinder is connected to a downwardly extending bracket 34 on the rear edge portion 24 of the closure.

Upper end 33 of piston cylinder 27 is connected to the bracket 34 by a connector 35.

In the illustrated embodiment, connectors 31 and 35 are formed of a synthetic resin so as to be weaker than the piston rod 29 which may be formed of mild steel so as to be somewhat flexible. Thus, in the event of impact forces and the like, the connectors are apt to fracture rather than the piston rod, thereby effectively preventing damage to the gas spring.

As the connector 31 is connected to the bracket 32 substantially above the top surface 36 of the shelf 16, objects placed on the shelf are effectively prevented from damaging the lower end of the gas spring, thereby effectively increasing the useful life thereof.

As seen in FIG. 4, the upper shelf 15 is provided with a through opening 37 through which the spring 26 extends from the bracket 32 to the bracket 34. As seen in FIG. 4, the spring extends generally at the same upright angle to the plane of the rear wall 23 in both the closed position of closure 19 and the open position thereof, thereby effectively minimizing fore-and-aft swinging of the spring in the movement of the closure between closed and open positions.

As further illustrated in FIG. 4, the spring is disposed closely adjacent rear wall 23, and as indicated in FIG. 2, the spring is located closely adjacent the sidewall 17. As further illustrated in FIG. 2, two such springs may be provided at the opposite sidewalls 17 and 18 of the receptacle, with the upper ends thereof being connected to the closure by brackets 34 at opposite end portions 38 and 39 of the closure panel 19.

As further seen in FIG. 3, top shelf 15 is provided with an upstanding wall 40 inwardly of the spring 26 for further protecting the spring against damage by objects placed on the shelf 15.

As best seen in FIG. 3, the upper brackets 34 comprise L-shaped brackets having a forwardly extending leg spaced most inwardly of the distal edges of the closure panel end portions 38 and 39 so as to angle the springs 26 inwardly away from the sidewalls 17 and 18 of the receptacle, as illustrated in FIG. 2. By such angling, effective clearance is provided between the sidewalls of the receptacle and the springs in the normal movement of the closure between the closed and open positions.

In the closed position of FIG. 4, the lifting force developed by the springs 26 is preselected to be slightly less than the downward force caused by the weight of the closure. In the open position shown in broken lines in FIG. 4, the lifting force of the spring is caused to be slightly greater than the downward force caused by the weight of the closure so as to effectively maintain the closure in the upright, open position. In the illustrated embodiment, the closure is moved to slightly over vertical center in the open position, and more specifically, in the illustrated embodiment, is approximately 3° beyond vertical so as to provide further effective retention of the closure in the open position.

However, as indicated above, when the closure moves down from the upright, open position beyond the vertical position and downwardly on hinge 25 to the closed position, the substantial counterbalancing or lifting force developed by the springs 26 causes the closure to be gently lowered to the closed position, thereby avoiding injury to a user's hands or the like accidentally disposed on the top edge 42 of the front wall 43 of the receptacle, or on the top edges 44 and 45 of the sidewalls 17 and 18, respectively.

In an intermediate position between the closed position shown in full lines in FIG. 4 and the open position shown in broken lines therein, the lifting force of the spring is substantially equal to the downward force caused by the weight of the closure. In the intermediate position, the lower edge of the front panel 21 is disposed adjacent the top edges 44 and 45 of the sidewalls 17 and 18 and, thus, as the weight of the closure is effectively balanced, injury to the user's fingers or hands on the top edges of the cabinet sidewalls is effectively precluded.

In one improved form of the storage box structure 10, the gas springs 26 were selected to develop approximately 120 p.s.i. pressure in the extended arrangement where the cover 13 weighed approximately 84 lbs. The use of the two springs 26 in this structure provided excellent assist in the movement of the closure between the closed and open positions, providing a gentle closing of the storage box notwithstanding the substantial weight of the closure.

The invention comprehends utilizing a relatively stiff spring so that a short moment arm may be utilized, permitting the springs to be mounted at the rear of the box adjacent the hinge 25 while yet providing the desirable assist in the control of the closure movement. By placing the springs in the rear corners of space 14, they are effectively protected against injury from articles placed in the box and, as discussed above, additional wall means may be provided for further protecting the springs. As a result of the protected disposition of the springs, the piston rod may be made of relatively mild steel to permit some flexing or bending thereof in use so as to effectively minimize the chance of breaking or fracture of the rod.

In the illustrated embodiment, a pair of L-shaped vertical cover walls 46 is provided disposed one each in surrounding relationship to the lower portion of the respective springs below the shelf 15. Walls 46 provide further protection to the spring piston rods. As shown, the walls 46 may be secured to the sidewalls 17,18, rear wall 23, and shelf 15 by suitable means, such as tack welding, to further protect the piston rods against inadvertent knicking or other deformation by tools, etc., placed in the box as on shelf 16.

The mounting brackets may be formed of steel with the connectors, as discussed above, being formed of a weaker material, such as synthetic resin, so as to permit fracture thereof rather than other parts of the spring system.

The foregoing disclosure of specific embodiments is illustrative of the broad inventive concepts comprehended by the invention.

We claim:

1. In a storage box having an upwardly opening receptacle having a rear portion defining a rear wall, and a heavy metal closure swingably mounted to said rear wall for selective positioning in a raised open position and a lowered, receptacle-closing position, the improvement comprising:

an elongate, longitudinally expansible spring having a lower end and an upper end;

means for connecting said lower end to said receptacle rear portion; and means for connecting said upper end to said closure adjacent said rear wall, said spring developing a lifting force preselected to be slightly less than the downward force caused by the weight of the closure in said receptacle-closing position, slightly more than the downward force caused by the weight of the closure in said open position, and substantially equal to the downward force caused by said closure in an intermediate position intermediate said receptacle-closing and open positions.

2. The storage box structure of claim 1 wherein said spring includes means for controlling the rate of movement of said closure between said positions.

3. The storage box structure of claim 1 further including wall means disposed adjacent said spring for preventing engagement with said spring of objects placed in said receptacle for preventing damage to said spring by said objects in the use of the storage box.

4. The storage box structure of claim 1 wherein said receptacle includes a horizontal shelf adjacent said rear wall and having an opening therein, said spring extending through said opening.

5. The storage box structure of claim 1 wherein said connecting means are constructed to have a break strength less than that of the spring for effectively precluding breaking of the spring in use of the storage box.

6. The storage box structure of claim 1 wherein said spring is provided with a connecting portion connected to one of said connecting means and being formed of mild steel for permitting limited flexure thereof without fracture in use of the storage box.

7. The storage box structure of claim 1 wherein said spring extends in a similar upright direction in each of said receptacle-closing and open positions.

8. The storage box structure of claim 1 wherein said closure is disposed in an upright disposition in said open position.

9. The storage box structure of claim 1 wherein said closure is disposed in an upright disposition beyond the vertical in said open position.

10. The storage box structure of claim 1 wherein said receptacle defines a horizontal shelf, and said means for connecting said lower end of the spring extends upwardly from said shelf for disposing said lower end above said horizontal shelf for preventing damage to said lower end by objects placed on said horizontal shelf in the use of the storage box.

11. The storage box structure of claim 1 wherein said receptacle defines opposite sidewalls and said closure defines end portions aligned with said sidewalls, said means for connecting the upper end of said spring to the closure comprising means for positioning the upper end inwardly of the closure end whereby the spring extends angularly upwardly inwardly from said lower end.

12. The storage box structure of claim 1 wherein said receptacle defines opposite sidewalls and said closure defines end portions aligned with said sidewalls, a pair of said springs is provided, said springs having their upper ends connected to said closure at said end portions, said means for connecting said upper ends comprising L-shaped supports reversely mounted to said closure at said end portions with said spring upper ends being connected to forwardly projecting legs of the L-shaped supports and said legs being disposed at the portion of the support most remote from the distal edge of the closure end portions.

13. The storage box structure of claim 1 further including a cover wall mounted to said receptacle and extending about said spring lower end for preventing engagement with said spring of objects placed in said receptacle for preventing damage to said spring by said objects in the use of the storage box.

14. The storage box structure of claim 1 wherein said receptacle includes a horizontal shelf adjacent said rear wall and having an opening therein, said spring extending through said opening with said lower end being disposed below said shelf, and structure further including a cover wall extending about said spring lower end for preventing engagement with said spring of objects placed in said receptacle for preventing damage to said spring by said objects in the use of the storage box.

15. In a storage box having an upwardly opening receptacle having a rear portion defining a top edge portion and a rear wall, and a heavy metal closure swingably mounted to said rear wall for selective positioning in a raised, open position and a lowered, receptacle-closing position, said closure having articulated portions including a front portion extending substantially vertically in the different positions of the closure, the improvement comprising:

an elongate, longitudinally expansible spring having a lower end and an upper end;

means for connecting said lower end to said receptacle rear portion; and means for connecting said upper end to said closure adjacent said rear wall, said spring developing a lifting force preselected to be slightly less than the downward force caused by the weight of the closure in said receptacle-closing position, slightly more than the downward force caused by the weight of the closure in said open position, and substantially equal to the downward force caused by said closure in an intermediate position intermediate said receptacle-closing and open positions, said closure front portion being juxtaposed to said receptacle top edge portion in said intermediate position whereby downward movement of said closure from said open position as by being wind-blown results in a substantially weight-balanced engagement of said closure front portion with said receptacle top edge portion for preventing injury to a user's hands or the like disposed therebetween as upon such downward movement.

16. The storage box structure of claim 15 wherein said closure front portion hangs downwardly in said open and intermediate positions.

17. The storage box structure of claim 15 wherein said closure front portion hangs downwardly below said receptacle top edge portion in said receptacle-closing position.

18. The storage box structure of claim 15 wherein said closure has a weight of greater than approximately 75 lbs.

19. The storage box structure of claim 15 wherein said means for connecting the upper end of the spring is positioned on said closure to angle the spring away from said top edge for effectively preventing interference with the biasing action of the spring.

20. The storage box structure of claim 15 further including means for covering at least one end of the spring for preventing engagement with said spring of objects placed in said receptacle for preventing damage to said spring by said objects in the use of the storage box.

* * * * *